US009068365B2

(12) United States Patent
Berset et al.

(10) Patent No.: US 9,068,365 B2
(45) Date of Patent: Jun. 30, 2015

(54) ANCHORING THE ENDS OF TENSION MEMBERS ON REINFORCED CONCRETE BEAMS

(71) Applicant: SIKA TECHNOLOGY AG, Baar (CH)

(72) Inventors: Thierry Berset, Winterthur (CH); Heinz Bänziger, Freienstein (CH)

(73) Assignee: SIKA TECHNOLOGY AG, Baar (CH)

( * ) Notice: Subject to any disclaimer, the term of this patent is extended or adjusted under 35 U.S.C. 154(b) by 0 days.

(21) Appl. No.: 13/871,502

(22) Filed: Apr. 26, 2013

(65) Prior Publication Data

US 2013/0232895 A1 Sep. 12, 2013

Related U.S. Application Data

(63) Continuation of application No. PCT/EP2011/068903, filed on Oct. 27, 2011.

(30) Foreign Application Priority Data

Oct. 28, 2010 (EP) ..... 10189323

(51) Int. Cl.
*E04C 5/08* (2006.01)
*E04G 23/02* (2006.01)

(52) U.S. Cl.
CPC ..... *E04G 23/0218* (2013.01); *Y10T 29/49632* (2015.01)

(58) Field of Classification Search
CPC ..... E04C 3/18; E04C 3/20; E04C 3/26
USPC ..... 52/223.1, 223.6, 223.8, 223.13, 223.14
See application file for complete search history.

(56) References Cited

U.S. PATENT DOCUMENTS 318,648 A * 5/1885 Paradise ..... 52/703
1,970,966 A * 8/1934 Leake ..... 29/897.1
2,380,953 A * 8/1945 Dubassoff ..... 52/223.8

(Continued)

FOREIGN PATENT DOCUMENTS

CA 2548508 A1 * 6/2005 ..... E04C 3/26
DE 199 44 573 A1 3/2001

(Continued)

OTHER PUBLICATIONS

International Search Report (PCT/ISA/210) issued on Jan. 24, 2012, by the European Patent Office as the International Searching Authority for International Application No. PCT/EP2011/068903.

(Continued)

*Primary Examiner* — Charles A Fox
*Assistant Examiner* — Joseph J Sadlon
(74) *Attorney, Agent, or Firm* — Buchanan Ingersoll & Rooney, PC

(57) ABSTRACT

The disclosure relates to a device for anchoring the ends of tension members made of fiber-reinforced plastic flat strip lamellas on reinforced concrete beams that have a connecting piece and a flange with a horizontal flange lower face, two flange lateral faces, and two upper faces that run from the flange lateral faces to the connecting piece. A base plate can be positioned on the flange lower face in a horizontal manner, and at least one lateral part can be positioned along at least one flange lateral face in a vertical manner.

13 Claims, 5 Drawing Sheets

(56) References Cited

U.S. PATENT DOCUMENTS

| | | | | |
|---|---|---|---|---|
| 3,034,185 | A * | 5/1962 | Olsen | 403/347 |
| 3,341,995 | A * | 9/1967 | Docken | 52/223.13 |
| 3,568,380 | A * | 3/1971 | Stucky | 52/79.1 |
| 3,817,010 | A * | 6/1974 | Stegmuller | 52/223.1 |
| 4,456,405 | A * | 6/1984 | Galis | 405/288 |
| 5,175,968 | A * | 1/1993 | Saucke | 52/223.8 |
| 5,242,239 | A * | 9/1993 | Hosokawa | 403/258 |
| 5,479,748 | A * | 1/1996 | Siller | 52/231 |
| 5,535,562 | A * | 7/1996 | Huang et al. | 52/223.13 |
| 5,671,572 | A | 9/1997 | Siller-Franco | |
| 6,098,360 | A * | 8/2000 | Johnson | 52/283 |
| 6,105,321 | A * | 8/2000 | KarisAllen et al. | 52/223.8 |
| 6,345,473 | B1 * | 2/2002 | Fink et al. | 52/167.1 |
| 6,385,940 | B1 * | 5/2002 | Maier et al. | 52/223.1 |
| 6,511,727 | B1 * | 1/2003 | Bleibler et al. | 428/50 |
| 6,584,738 | B1 * | 7/2003 | Andra et al. | 52/223.14 |
| 7,448,103 | B2 * | 11/2008 | Reynolds | 14/4 |
| 8,375,652 | B2 * | 2/2013 | Hiriyur et al. | 52/167.3 |
| 8,539,629 | B2 * | 9/2013 | Han | 14/74.5 |
| 2005/0247016 | A1 * | 11/2005 | Andra et al. | 52/745.21 |
| 2006/0236644 | A1 * | 10/2006 | Bush | 52/634 |
| 2009/0013640 | A1 * | 1/2009 | Caroussos | 52/831 |
| 2011/0232221 | A1 * | 9/2011 | Tsai et al. | 52/656.9 |
| 2013/0160394 | A1 * | 6/2013 | Berset et al. | 52/741.1 |

FOREIGN PATENT DOCUMENTS

| | | | | |
|---|---|---|---|---|
| EP | 1 033 455 | A1 | 9/2000 | |
| JP | 2000-129929 | A | 5/2000 | |
| JP | 2002-364185 | A | 12/2002 | |
| JP | 2002364185 | A * | 12/2002 | E04G 23/02 |
| WO | WO 02/16710 | A2 | 2/2002 | |
| WO | WO 2004/038128 | A1 | 5/2004 | |
| WO | WO 2005066419 | A1 * | 7/2005 | E01D 2/00 |

OTHER PUBLICATIONS

Written Opinion (PCT/ISA/237) issued on Jan. 24, 2012, by the European Patent Office as the International Searching Authority for International Application No. PCT/EP2011/068903.

Notification of Transmittal of Copies of Translation of the International Preliminary Report on Patentability (Forms PCT/IB/338 and PCT/IB/373) and the Written Opinion of the International Searching Authority (Form PCT/ISA/237) issued by the International Patent Office on May 10, 2013, in the corresponding International Patent Application No. PCT/EP2011/068903. (9 pages).

* cited by examiner

ANCHORING THE ENDS OF TENSION MEMBERS ON REINFORCED CONCRETE BEAMS

RELATED APPLICATION(S)

This application claims priority as a continuation application under 35 U.S.C. §120 to PCT/EP2011/068903, which was filed as an International Application on Oct. 27, 2011 designating the U.S., and which claims priority to European Application 10189323.8 filed in Europe on Oct. 28, 2010. The entire contents of these applications are hereby incorporated by reference in their entireties.

FIELD

The disclosure relates to a device for anchoring the ends of tension members made of fiber-reinforced plastic flat strip lamellas on reinforced concrete, hereinafter reinforced concrete beams, which are equipped with a corresponding device as well as a method for anchoring the ends of the tension members on reinforced-concrete beams.

BACKGROUND INFORMATION

The reinforcement of load-bearing members, for example, while reconstructing existing structures, by attachment of tension members made of fiber-reinforced plastic flat-strip lamellas, which are glued to the load-bearing members under tension, is known, and can have advantages compared to reinforcement of load-bearing members by steel structures. Forces are admitted thereby principally at the ends of the tension member, with anchoring the ends of the tension members on the load-bearing member attaining special significance.

Application of anchoring to the ends a load-bearing member can be problematic with reinforced concrete structures, since the anchoring can be mounted on the ends of load-bearing member by being screwed on. With this, it can be problematical to apply anchorings to the ends of reinforced concrete structures that exhibit dense reinforcement, especially such as also exhibit a steel core under tension. Damage to the steel core in such load-bearing structures by drilling through the structure for insertion of bolt dowels can impair the load-bearing capacity of a reinforced concrete beam to a significant degree.

For example, anchorings which are attached with dowels to the ends of load-bearing members are described in WO 2004/038128 A1 and in WO 02/16710 A2.

An additional end anchoring, which is described, for example, in DE 199 44 573 A1, uses slits made in the surface of the load-bearing member.

Also known is simple adhesive attachment of an end anchoring on the surface of a load-bearing member. However, this solution can be accompanied by losses of load-bearing capacity of end anchoring in tensile loads, which are exerted by the tension member.

In a method known for applying an anchoring to the end of a load-bearing member made of reinforced concrete without damaging the steel core, the steel core is detected in a first step, so that the load-bearing member can be drilled past the steel armoring. Then the anchoring is manufactured to adapt to the arrangement of the holes and mounted onto the end of a load-bearing member. Such a method may not in fact impair the load-bearing capacity of the load-bearing member, but drilling the load-bearing member and manufacture of the end anchorings to adapt to the drilled holes can be expensive.

SUMMARY

A device is disclosed for anchoring ends of tension members made of fiber-reinforced plastic flat-strip lamellas on reinforced-concrete beams, including a connecting piece and a flange with a horizontal flange underside, two flange sides and two flange upper sides running from the flange sides to the connecting piece, the device comprising a base plate for running on the flange underside configured to be positioned horizontally, and at least one lateral part for running along a flange side configured to be positioned vertically. At least one of the base plate and the at least one lateral part include at least one attachment element for a tension member, and the at least one lateral part is arranged to be placed so, in an area where the flange tapers toward the connecting piece, it includes a protrusion for directing toward the connecting piece, which can be at least partially braced on at least one flange upper side.

A reinforced concrete beam is disclosed, comprising: a connecting piece; a flange with a horizontal flange underside; two flange sides; and two flange upper sides running from the flange sides to the connecting piece; at least one device for anchoring ends of tension members made of fiber-reinforced plastic flat-strip lamellas, the device including: a base plate running horizontally on the flange underside; and at least one lateral part running vertically along a flange side, wherein at least one of the base plate and the at least one lateral part includes at least one attachment element for a tension member; and the at least one lateral part in an area where the flange tapers toward the connecting piece, includes a protrusion directed toward the connecting piece, which can be at least partially braced on the flange upper side.

A method is disclosed for anchoring ends of tension members made of fiber-reinforced plastic flat-strip lamellas on reinforced-concrete beams, wherein the reinforced concrete beams include a connecting piece and a flange with a horizontal flange underside, two flange sides and two flange upper sides running from the flange sides to the connecting piece, the method comprising: installing a device on the reinforced-concrete beam, the device including a base plate running horizontally on the flange underside and at least one lateral part running vertically along at least one flange side, at least one of the base plate and the at least one lateral part including at least one attachment element for a tension member and the at least one lateral part, in an area of tapering of the flange to the connecting piece, includes a protrusion directed against the connecting piece, which is braced at least partially on a flange upper side; installation of a tension member on the attachment element; and placing of the tension member under tension.

The figures only show exemplary elements essential for direct understanding of the disclosure.

DETAILED DESCRIPTION

Exemplary embodiments of the present disclosure are directed to a device for anchoring of the ends of tension members made of fiber-reinforced plastic flat-strip lamellas on reinforced-concrete beams, which, without damaging the steel core, can be simply attached to a reinforced-concrete beam but nonetheless can admit a large tensile load.

Accordingly, an exemplary embodiment of the disclosure includes a device for anchoring the ends of tension members made of fiber-reinforced plastic flat strip lamellas on reinforced-concrete beams, which exhibits a connecting piece and a flange with a horizontal flange underside, two lateral flange sides and two flange surfaces which extend from the flange side toward the connecting piece.

The device includes a base plate positioned horizontally on the flange underside, and at least one lateral piece placed vertically along a flange side, The base plate and/or the at least one lateral piece exhibits at least one attachment element for a tension member.

The at least one lateral piece is arranged so that, in the area where the flange tapers toward the connecting piece, it exhibits a projection that is directed toward the connecting piece, which is so arranged that it can be braced at least partially on the flange upper side.

The disclosure-specific device can be easily mounted on a reinforced-concrete beam and, compared with the anchorings for the ends of tension members on reinforced concrete beams which are known, exhibits numerous advantages.

Compared with the anchorings which are screwed onto the surface of the ends of load-bearing member, the disclosure-specific device can have an advantage in that it results without drilling into the surface of the load-bearing member to set the bolt dowels, through which there is no danger of weakening the load-bearing member by damaging the steel core.

Surprisingly, it was found that the disclosure-specific device, for example, through the engagement of the at least one side piece with the projection onto the flange upper side of a reinforced-concrete beam, and the wedging of the device produced under tension by the tension member, can admit a very great tensile load. The load-bearing capacity of the disclosure-specific device is comparable to that of screwed end anchorings, and exceeds by several times the load-bearing capacity of glued end anchorings.

With the aid of the drawings, exemplary embodiments of the disclosure are explained in greater detail. Identical elements in the various figures are designated with the same reference symbols. Naturally, the disclosure is not limited to the depicted and described exemplary embodiments.

Figure 1:
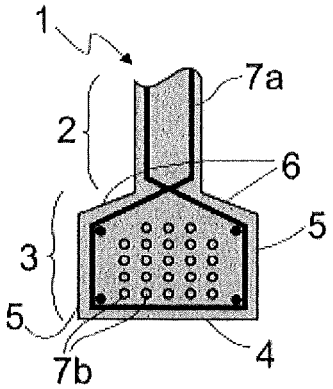
FIG. 1 is a schematic cross section through a reinforced concrete beam.

FIG. 1 shows a reinforced-concrete beam 1, which includes a connecting piece 2 and a flange 3 with a horizontal flange underside 4, two flange sides 5 and two flange upper sides 6 extending from the flange sides to the connecting piece. In addition, the reinforced-concrete beam exhibits a steel core, comprising (e.g., consisting of), for example, an untensioned steel core 7*a* extending in a transverse and longitudinal direction and a tensioned steel core 7*b* extending in the longitudinal direction. Along with a pronounced enhancement of tensile strength of reinforced concrete as compared to concrete without steel cores, the tensioned steel core additionally increases the cracking moment of a reinforced-concrete beam.

Figure 2:
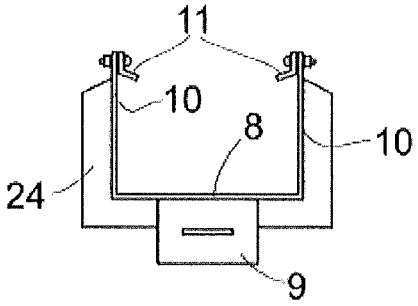
FIG. 2 is a schematic cross section through a device according to an exemplary embodiment of the disclosure for anchoring of the ends of tension members made of fiber-reinforced plastic flat strip lamellas.

FIG. 2 shows a device according to an exemplary embodiment of the disclosure which includes a base plate 8 which, as it is described in FIG. 1, can be positioned horizontally on the flange underside of a reinforced-concrete beam 1 with an attachment element 9 for a tension member as well as two lateral parts 10 that can be vertically positioned along the flange sides 5. In addition, the lateral parts are so placed that, in the area where the flange tapers toward the connecting piece, they each exhibit a protrusion 11 directed to the connecting piece. These projections are placed so that at least partially they can be braced on the flange upper side 6. Additionally, the device depicted is equipped with an optional rib 24, which adds rigidity to the device.

Figure 3:
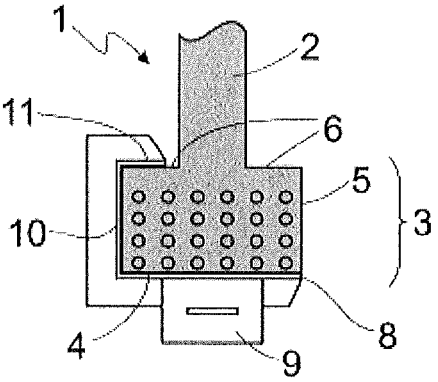
FIG. 3 is a schematic cross section through a reinforced-concrete beam with a device according to an exemplary embodiment of the disclosure with only one lateral piece.

Another exemplary embodiment of the device according to the disclosure, as it is already mounted on a reinforced-concrete beam 1, is depicted in FIG. 3, with this device, along with the base plate 8 with the attachment element 9 for a tension member, exhibiting only one lateral part 10 and correspondingly only one protrusion 11.

An exemplary embodiment of the device can be designed as a single piece or from multiple pieces. If it is a device which exhibits two lateral parts, then the device can be designed as a multiple-part one or it exhibits at least one joint, which permits a base plate, lateral parts and/or protrusions to be brought into the desired position on a reinforced-concrete beam.

An example is an embodiment of the device according to the disclosure as is depicted in FIG. 2, with multiple parts, in which the protrusions 11 are attached using bolts and bolt nuts on one of the lateral pieces 10. Such a device is installed from below on the reinforced-concrete beam 1 and then attached to it with the aid of the protrusions 11.

Figure 4:
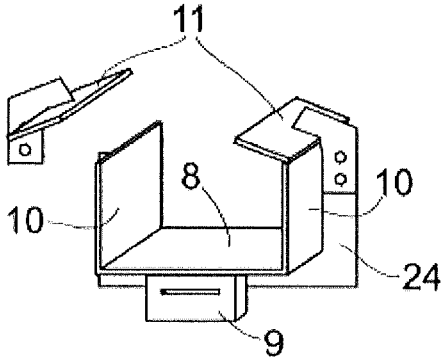
FIG. 4 is a schematic view of a device according to an exemplary embodiment of the disclosure for anchoring of the ends of tension members.

Another multi-part form of the device according to an exemplary embodiment of the disclosure is shown, for example, in FIG. 4. Along with the base plate 8, on which is found the attachment element 9 for a tension member, the lateral parts 10 and the protrusions 11 are shaped as plates, which, when the device is installed on the reinforced-concrete beam 1, is in contact with it. In the embodiment form depicted here, the ribs 24 have not merely a reinforcing function, but also serve simultaneously to attach the protrusions 11 to the lateral parts 10 of the device.

If the device according to an exemplary embodiment of the disclosure does not exhibit any reinforcing rib, the protrusions can be attached directly onto the lateral parts. For this purpose, the lateral pieces can project over the flange sides and, for example, exhibit boreholes, through which pins, screws or the like can be run to secure the protrusions.

Figure 5:
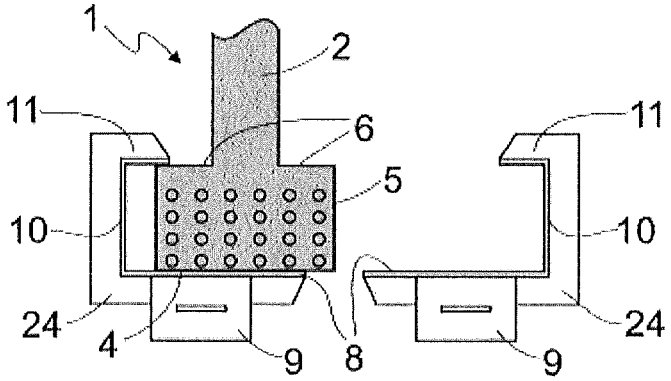
FIG. 5 is a schematic cross section through a reinforced-concrete beam and the assembly of a multi-component device according to an exemplary embodiment of the disclosure for anchoring of the ends of tension members.

Another multi-part device according to an exemplary embodiment of the disclosure is shown for example in FIG. 5. What is depicted is a two-part device, as it is about to be installed on a reinforced-concrete beam 1 as per the foregoing description. The depicted device includes two base plates 8 with an attachment element 9 for a tension member, each of which exhibits a lateral piece 10 with a protrusion 11. Placed opposite over one another, they form a disclosure-specific device. Such an embodiment form also exhibits an arrangement by which the two device parts can be connected to each other or the attachment is implemented by insertion of the tension member into the attachment element 9 provided for this.

Figure 6:
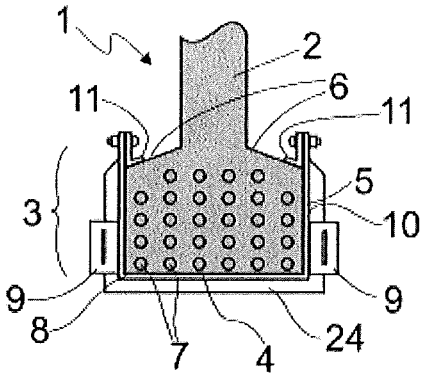
FIG. 6 is a schematic cross section through a reinforced concrete beam with a device according to an exemplary embodiment of the disclosure with attachment elements placed laterally for tension members.

FIG. 6 for example shows a device according to an exemplary embodiment of the disclosure which is mounted on a reinforced-concrete beam 1. The device includes a base plate 8 adjoining on the flange underside 4 of a reinforced-concrete beam 1 and two lateral parts 10 that run vertically along the flange sides 5. In addition, each of the two lateral parts exhibits an attachment element 9 for a tension member and a protrusion 11. The protrusions are placed so that they are braced on the flange upper side 6, thus serving to attach the device to the reinforced-concrete beam. In addition, the depicted device is provided with an optional rib 24 to increase the rigidity.

In order to obtain, with the installation of tension members made of fiber-reinforced plastic flat-strip lamellas onto reinforced-concrete beams, as efficient a reinforcement of the beam as possible, the tension members, and correspondingly the attachment arrangement can be installed in the lower area of the lateral parts of the device or on the flange underside.

Exemplary embodiments of the device can include metal, a metallic alloy or another high-strength material.

Depending on the dimension of the reinforced-concrete beam to be reinforced, and in dependence on the need for reinforcement, the device according to an exemplary embodiment of the disclosure can exhibit one or more attachment elements for tension members. For example, the device can exhibit 1 to 4 attachment elements.

As the attachments, any systems for application of force in tension members can be used, with the attachment element and the tension member that is to be secured to the attachment element needing to be adjusted to each other.

If the attachment element is a clamping device in which, for example, the end of the tension member is clamped between two plates, no alterations can be made on the tension member for the attachment.

If the attachment element is a slotted plate, on each end of the tension member a grip head is attached. With such an attachment element, the tension member is guided through the slot of the slotted plate, so that the grip head, as viewed in the tensioning direction of the tension member, is situated behind the slotted plate.

Suitable systems for applying force in tension members are described for example in EP1017379.2. Especially suitable systems for applying force in tension members are the subject of the patent application, the entire disclosure of which is hereby included by reference.

For example, the attachment element is a slotted plate which is used in connection with a tension member having a grip head. The slotted plate can be braced in the direction of tension of the tension member with ribs or the like on the base plate or on the lateral part.

Additional exemplary embodiments of the disclosure are described in what follows in part in connection with reinforced-concrete beams onto which they are attached. Reinforced concrete beams with the device are likewise the subject of the present disclosure.

For example, the reinforced-concrete beams can be such as are described in FIG. 1. The device in addition is one such as has been described above.

Accordingly, exemplary embodiments of the disclosure can also include a reinforced-concrete beam which exhibits a connecting piece 2 and a flange 3 with a horizontal flange underside 4, two flange sides 5 and two flange upper sides 6 extending to the connecting piece. The reinforced-concrete beam 1 can include at minimum one device for anchoring the ends of tension members made of fiber-reinforced plastic flat-strip lamellas, wherein:

- the device exhibits a base plate 8 running horizontally on the flange underside 4, and at least one lateral piece 10 running vertically along a flange side 5;
- the base plate and/or the at least one lateral piece exhibits at least one attachment element 9 for a tension member; and wherein
- the at least one lateral part, in the area where the flange tapers toward the connecting piece, exhibits a protrusion 11 directed toward the connecting piece, which is at least partially braced on the flange upper side 6.

Regardless of the embodiment of the device or of the reinforced-concrete beam which exhibits such a device, the device can be adhesively bonded with the reinforced-concrete beam. For this especially, dual-component adhesives based on epoxy resins can be used, which can exhibit high or low viscosity and if necessary can be filled. Examples of suitable adhesives that can be obtained are the ones under the trade name SIKADUR from Sika Schweiz AG.

By adhesive bonding or filling of the intermediate space between the reinforced-concrete beam and the device, the base plate 8 is connected in adherence-actuated fashion with the flange underside 4 to transfer thrust and compressive forces. To make possible a transmission of compressive forces between the protrusion 11 and the flange upper side 6, the device can be manufactured to adapt to the dimensions of the flange, or adjusted to it during assembly, or an intermediate space between the protrusion 11 and flange upper side is filled in adherence-actuated fashion by filling or adhesive bonding. If the device is loaded on the attachment element 9 orthogonal to the cross-sectional plane, then tangential deformations appear in the direction of loading in the boundary layer between base plate 8 and flange underside 4. With adherence-actuated contact without play between protrusion 11 and flange upper side 6, there results from it a torsion about the contact surface between protrusion 11 and flange upper side 6. If the device has been designed to be sufficiently rigid, what results from the torsion is a compression force between base plate 8 and flange underside 4, directed orthogonally to the contact surface, as well as an equal amount of compression force between protrusion 11 and flange upper surface 6. The compression force in the boundary surface between base plate 8 and flange underside 4 can result in a substantial enlargement of the force able to be transmitted in the tangential direction.

The reinforced-concrete beam may not have drilled holes for attachment of the device. Especially in this regard the connecting piece of the reinforced-concrete beam is not drilled through.

Especially in the area where the device is installed, the reinforced-concrete beam exhibits a recessed pocket and at least a part of the device can be placed into the recessed pocket. The recessed pocket can be on the flange underside or on the flange sides. In certain cases the recessed pocket can extend to the flange upper sides.

Especially the recessed pocket can be located on those sides of the reinforced-concrete beam on which the device to be attached exhibits the at least one attachment element for a tension member.

If the device exhibits a base plate with an attachment element for a tension member, the recessed pocket is situated on the flange underside. If the device exhibits attachment elements on at least one lateral part, the recessed pocket is on the at least one flange side on which the lateral part is installed with the attachment element.

Figure 7:
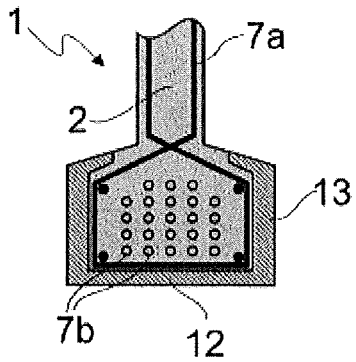
FIG. 7 is a schematic cross section through a reinforced-concrete beam with an area of recessed indentations.

FIG. 7 shows a reinforced-concrete beam 1 as has already been described in FIG. 1, wherein here the areas are shown over which the recessed pocket 12, 13 can extend. If, instead of the reinforced-concrete beam which exhibits the recessed pocket, provision is made to place a device for anchoring of the ends of tension members made of fiber-reinforced plastic flat-strip lamellas, in which the tension member is secured to the base plate, then the reinforced-concrete beam 1 can exhibit a recessed pocket 12 on the flange underside 4. If a device is installed in which the tension member is secured onto a lateral part 10, then especially the recessed pocket 13 can be found on the corresponding flange side 5. If both lateral parts 10 exhibit attachment elements, then there can be a recessed pocket on both sides.

The recessed pocket can have an advantage in that the tension member can be placed on the reinforced-concrete beam with no interval. By this, any deflection of the tension member from the device to the surface of the reinforced-concrete beam, to the flange underside for example, can be reduced or dispensed with altogether. A recessed pocket can be suitable if a system including a slotted plate and grip head, is used to apply force to the tension member. In this case the pocket, against the tensile direction of the tension member, extends also over the area on which the disclosure-specific device is placed, thus making room for the grip head.

Another exemplary advantage of the recessed pocket can be better force transmission from the device into the reinforced concrete beam, since the device can at least partially be braced on the flank of the recessed pocket in the tensile direction of the tension member.

The recessed pocket can extend far enough into the reinforced-concrete beam that the device to anchor the ends of tension members made of fiber-reinforced plastic flat strip lamellas can be placed in the pocket so that the installed tension member can be installed in a tensioned state with a reduced deflection, or with no deflection on the surface of the reinforced-concrete beam. The pocket for example, can extend at maximum to the steel core of the reinforced-concrete beam.

Figure 8:
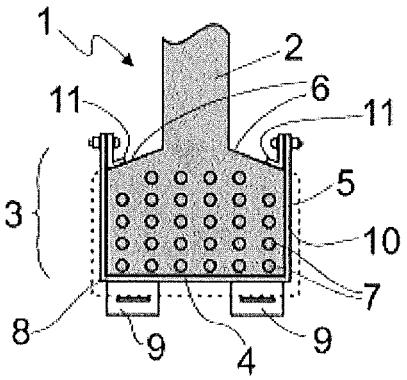
FIG. 8 is a schematic cross section through a reinforced-concrete beam with a device according to an exemplary embodiment of the disclosure having two attachment elements lying beneath for tension members.

FIG. 8 shows an exemplary device according to the disclosure which is mounted on a reinforced-concrete beam 1. The reinforced-concrete beam shown exhibits a recessed pocket on the flange underside 4 and on both flange sides 5. The dashed line shows the contour of the reinforced-concrete beam 1 at the locations without a recessed pocket. The device exhibits a base plate installed on the recessed pocket on the flange underside of the reinforced-concrete beam, with two attachment elements 9 for tension members as well as two lateral parts 10 running vertically along the flange sides 5, each with a protrusion 11. The protrusions are so placed that they are braced on the flange upper side 6, and thus contribute to the attachment of the device on the reinforced-concrete beams. The recessed pocket extends to the area of the steel core 7 of the reinforced-concrete beam.

Figure 9:
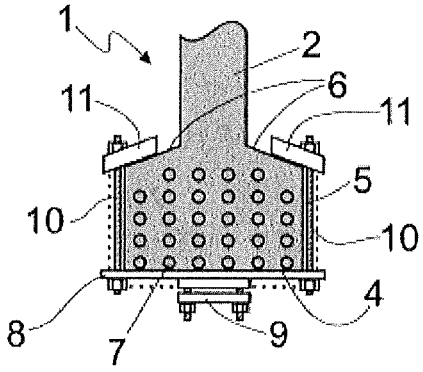
FIG. 9 is a schematic cross section through a reinforced-concrete beam with a device according to an exemplary embodiment of the disclosure having lateral pieces in the form of threaded rods.

FIG. 9 shows an exemplary embodiment a device according to the disclosure which is mounted on a reinforced-concrete beam 1. In contrast to the device as it is depicted in FIG. 8, here the lateral parts 10 can be configured as threaded rods which connect the base plate 8 and the protrusions 11 with each other. In addition, the attachment element 9 depicted in FIG. 9 is a clamping device at which the end of the tension member is clamped between two plates.

If the lateral parts are threaded rods, then a lateral part of the device can include at least two such threaded rods. This can improve the stability of the device.

Figure 10:
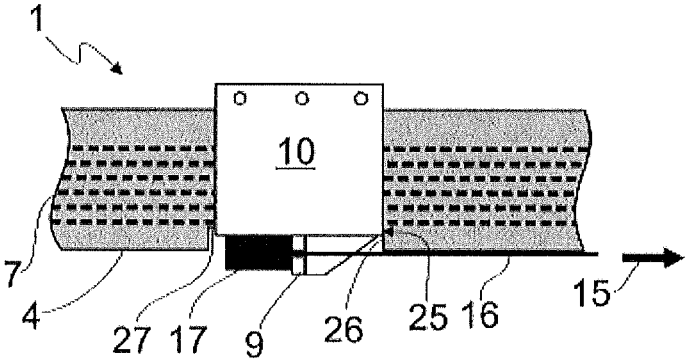
FIG. 10 is a schematic partial longitudinal section of a reinforced concrete beam with a device according to an exemplary embodiment of the disclosure and an attached tension member.

FIG. 10 also shows a device according to an exemplary embodiment of the disclosure which is mounted on a reinforced-concrete beam 1. The depicted reinforced-concrete beam exhibits a recessed pocket on the flange underside 4, with the pocket extending to the area of the steel core 7. The device exhibits a base plate installed in the recessed pocket on the flange underside of reinforced-concrete beam 1, with an attachment element 9 for a tension body as well as lateral parts 10 running vertically along the flange sides, each with a protrusion. The protrusions are so arranged that they are braced on the flange upper side and thus serve to attach the device to the reinforced-concrete beams. In addition, FIG. 10 shows the tension body 16 installed on the device, which, by the grip head 17 is installed on attachment element 9. The tensile direction 15 of tension body 16 is indicated by an arrow.

If the device is mounted on a reinforced-concrete beam which is equipped with a recessed pocket for the base plate, then the force applied on attachment element 9 in the intended tensile direction 15 is transmitted not merely by tangential forces in the boundary surface between base plate 8 and flange underside 4, but also by compression forces between the front side 25 of the base plate and the flank 26 of the recessed pocket. The torsion of the device resulting from the application of a force in the intended tensile direction 15 on attachment element 9 generates compression forces between base plate 8 and the base 27 of the recessed pocket. The compression force directed orthogonally to the boundary surface between base plate 8 and the base 27 of the recessed pocket leads to an increase in the tangential resistance of the boundary surface in comparison to a connection without compression force.

The forces behave similar to this in a device which exhibits at least one attachment element 9 on at least one flange side 5 of the reinforced-concrete beam.

Figure 11:
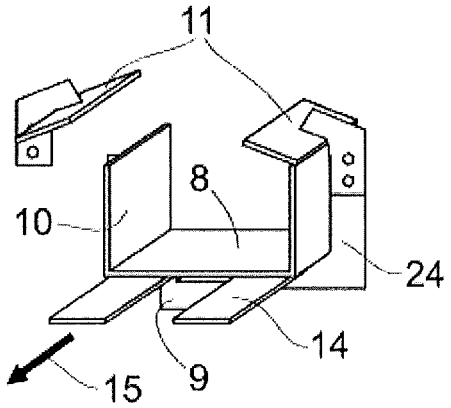
FIG. 11 is a schematic view of a device according to an exemplary embodiment of the disclosure with an extension.

Another exemplary embodiment of the device according to the disclosure is shown for example in FIG. 11, wherein the base plate 8 of this device, in contrast to that in FIG. 4, additionally exhibits an extension 14, which extends in the intended tensile direction 15 of the tension member.

The torsion of the device resulting from the application of a force by the tension member 16 in the tensile direction 15 on attachment element 9, generates, along with the compression forces between base plate 8 and the base 27 of the recessed pocket, compression forces between the extension 14 and the flange underside 4. These compression forces applied via the extension 14 to the flange underside, directed orthogonal to the concrete surface, can result in an increase in compression strength of the concrete and thus in an increase in the force able to be transmitted via compression forces between the front surface 25 of the base plate and the flank 26 of the recessed pocket.

An extension, as is depicted in FIG. 11 on the base plate of the disclosure-specific device, can be desirable per se regardless of the embodiment form of the disclosure. Additionally, such an extension does not of necessity have to extend over the flange underside, but can be installed where the reinforced concrete beam exhibits a recessed pocket to admit the base plate or at least one of the lateral parts, depending on which of these parts an attachment element for the tension member is provided for.

In addition, the extension as depicted in FIG. 11, can include two parts, which are each situated on a side along the tension member. However, the extension can also extend over the area of the tension member, and in fact between the tension member and the reinforced-concrete beam or so that the tension member is placed between the extension and the reinforced-concrete beam. If the extension is located between the tension member and the reinforced-concrete beam, the tension member can be deflected by the height of the extension to the flange underside of the reinforced-concrete beam.

The device according to an exemplary embodiment of the disclosure can be configured so that the base plate with the attachment for the tension member and/or the at least one lateral part with the attachment element for the tension member exhibits an extension, which extends in the intended tensile direction of the tension member.

The extension can be formed in that the base plate and/or the lateral part exhibits at least one second plate that at least in part overlaps the base plate, with the second plate projecting over the base plate in the intended tensile direction of the tension member.

Figure 12:
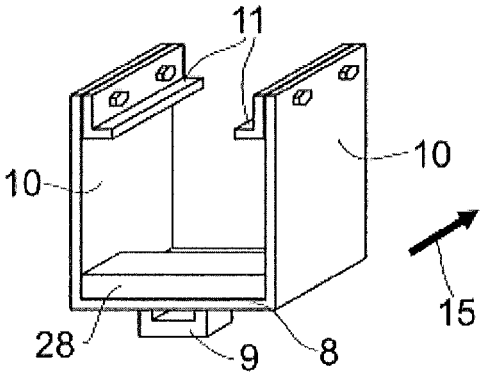
FIG. 12 is a schematic view of a device according to an exemplary embodiment of the disclosure with a protruding element.
Figure 13:
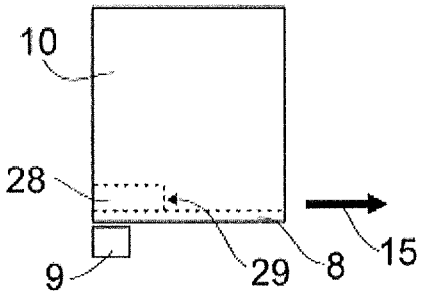
FIG. 13 is a schematic longitudinal section through the device from FIG. 13.

An exemplary embodiment of the disclosure for anchoring the ends of tension members made of fiber-reinforced plastic flat strip lamellas to reinforced-concrete beams, which exhibits a recessed pocket at least on the flange underside, includes a base plate with at least one element projecting out in the direction of the lateral parts, and is shown in FIGS. 12 (view) and 13 (cross section). The base plate 8 of the depicted device exhibits at least one projecting element 28, which is configured to be at least partially complementary to the recessed pocket on the flange underside of the reinforced-concrete beam. For example, the projecting element 28 can be configured as a spindle, which projects only over a part of the width of the reinforced-concrete beam into it. However, the projecting element 28 is especially configured as a beam, which extends over the entire width of the device.

Figure 14:
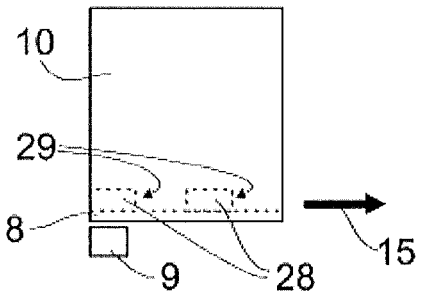
FIG. 14 is a schematic cross section through a device according to an exemplary embodiment of the disclosure with two protruding elements.

Additionally, the disclosure-specific device can also exhibit a plurality of projecting elements 28, which likewise can be configured as spindles or beams. If the device is one which has a plurality of projecting elements, then it especially exhibits multiple beams that are at a distance to, and parallel to, each other. For example, FIG. 14 shows a device with two beams as projecting elements 28, which are installed on base plate 8.

In exemplary embodiments of the disclosure, in which the base plate exhibits at least one projecting element 28, it can be desirable that the recessed pocket extend at maximum to the steel core of the reinforced-concrete beam. Therefore also the maximum height by which the projecting element can extend out from the base plate, matches the distance of the flange underside of the reinforced-concrete beam to its steel core.

Figure 15:
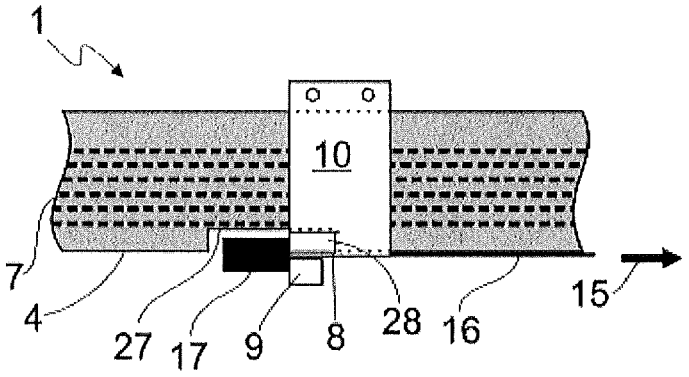
FIG. 15 is a schematic partial longitudinal section of a reinforced-concrete beam with a device according to an exemplary embodiment of the disclosure having a protruding element and an attached tension member.

FIG. 15 shows a device which is mounted on a reinforced-concrete beam 1, wherein the depicted reinforced-concrete beam exhibits a recessed pocket on the flange underside 4, which extends into the area of the steel core 7. The recessed pocket is configured so that it can admit the projecting element. In addition, the pocket depicted here, going against the tensile direction 15 of tension member 16, extends over the area on which the device is installed. This facilitates the use of a grip head 17 for installing tension member 16 onto attachment element 9 of the device. In addition, the device shown in FIG. 15, on the rear part of base plate 8, exhibits a projecting element 28 in the form of a beam, which projects into the recessed pocket. The dashed lines show the invisible configuration of the reinforced-concrete beam.

The exemplary embodiments of the disclosure, in which the base plate exhibits at least one projecting element 28, can fulfill the same function as the embodiment of the disclosure with a base plate and extension.

In addition to the tangential forces in the boundary surface between base plate 8 and flange underside 4, in both exemplary embodiments, compression forces can be transferred between the front surface 25 of the base plate or the front surface of the projecting element 28 and the flank 26 of the recessed pocket. Additionally, each part of the base plate, which, viewed in the tensile direction of the tension member, lies before projecting element 28, acts in the same way as an extension of the base plate in an embodiment of the disclosure without a projecting element.

The exemplary embodiments of the disclosure described herein, in which the base plate exhibits at least one projecting element 28, can be desirable, among other reasons, because it is easy to manufacture and easy to handle when being mounted on a reinforced-concrete beam.

For example, such a device can be manufactured by bending a metal plate into a U profile, or fitting multiple metal plates into a U profile, for example by screw connections, riveting, welding, adhesive bonding and the like. With a U profile, the profile base forms the base plate and the two arms form the lateral parts. After that, at least one projecting element, for example, a steel beam on the profile base, can be installed in the direction transverse to the U profile or to the longitudinal course of the reinforced-concrete beam. The steel beam can be attached in the rear area of the U profile, for example, flush against the base plate, as viewed in the tensile direction of the tension member.

The reinforced-concrete beams depicted in FIGS. 10 and 15 each exhibit devices for anchoring the ends of tension members made of fiber-reinforced plastic flat strip lamellas, which do not exhibit any tensioning system or tensioning element for the tension member. Depending on the system that is used to apply force to the tension member, such devices can be used on both ends of the tension member.

This is the case, for example, if the tension member is brought along the reinforced-concrete beam and through the attachment elements of the devices on both ends of the tension member, and the grip heads are only installed on the tensioned tension member, as viewed in the tensile direction of the tension member, behind the attachment elements. Likewise, there is no need for a tensioning element if the attachment element is itself a clamping device for clamping of the tensioned tension member. This for example would be two plates, between which the tensioned tension member would be clamped, as it is depicted in FIG. 9.

Regardless of the embodiment of the disclosure device or of the reinforced concrete beam which such a device exhibits, the device can be wedged to the reinforced-concrete beam. Tensioning, which especially is applied by the tension which the tension member 16 exerts in tensile direction 15, produces the wedging.

In another exemplary embodiment of the disclosure, the device for anchoring the ends of tension members made of fiber-reinforced plastic flat-strip lamellas can be equipped with a tensioning element to put tension on the tension member.

For this, the tension element has the function of tightening the tension member, after it has been installed on the disclosure-specific device. This can be done by threaded rods or by hydraulic pressing or tension-applying machines.

Figure 16:
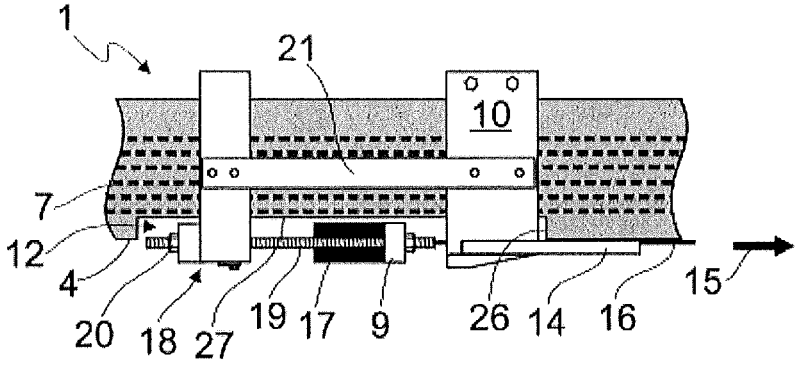
FIG. 16 is a schematic partial longitudinal section of a reinforced-concrete beam with a device according to an exemplary embodiment of the disclosure having a tension element, extension and an attached tension member.

For example, FIG. 16 shows a reinforced-concrete beam 1 with a device to anchor the ends of tension members made of fiber-reinforced plastic flat-strip lamellas, as previously described, wherein the device is equipped with a tensioning element 18 to tighten tension member 16.

Like the device itself, the depicted tensioning element 18 includes a base plate, lateral parts and if desired, protrusions. In addition, it includes threaded rods 19, which are connected with the attachment element 9 for the tension member of the device. By tightening the bolt nuts 20, tension can be exerted on the attachment element 9, which causes tension member 16 to be put in tension. The tension element 18 is connected via limbs or plates 21 with the lateral parts 10 of the device.

In an exemplary embodiment of the disclosure, the connection between the tensioning element 18 and the disclosure-specific device by limbs or plates 21 can be dispensed with. Instead of that, the tensioning element 18 can be secured onto the reinforced-concrete beam.

After the tension member 16 has been put in tension, the tension element 18 can be left on the reinforced-concrete beam, or after the grip head has been fixed with a tension member in tension, it can again be removed. The grip head can be fixed, for example, by backfilling the area between the disclosure-specific device and the grip head. Materials based on cement or plastics like epoxy resins are suitable for backfilling.

Additionally, exemplary embodiments of the disclosure relates to a method for anchoring the ends of tension members made of fiber-reinforced plastic flat-strip lamellas on a reinforced-concrete beam 1, which includes a connecting piece 2 and a flange 3 with a horizontal flange underside 4, two flange sides 5 and two flange upper sides running from the flange sides 6 to the connecting piece, including:

i) Installing a device on a reinforced-concrete beam 1, wherein the device exhibits a base plate 8 running horizontally on the flange underside 4 and at least one lateral part 10 running vertically along at least one flange side 5;

the base plate and/or the at least one lateral part exhibits at least one attachment element 9 for a tension member; and wherein the at least one lateral part, in the area of the tapering of the flange to the connecting piece, exhibits a protrusion 11 directed against the connecting piece, which is braced at least partially on the flange upper side 6;

ii) Installation of a tension member on the attachment element 9;

iii) placing of the tension member under tension.

Prior to step i) of the method, for example, on reinforced-concrete beam 1, at least at the place where the base plate 8 with the attachment element 9 for the tension member and/or the lateral part 10 with the attachment element 9 for a tension member is to be installed, a recess is made for a pocket 12, 13. Then the base plate 8 is installed with the attachment element 9 for a tension member and/or the lateral part 10 with the attachment element 9 for a tension member, in the recessed pocket.

If the device is a device with a projecting element, the device can be installed on the reinforced-concrete beam so that the projecting element extends into the recessed pocket.

The recessed pocket extends, for example, at most down to the steel core of the reinforced-concrete beam.

The pocket can be recessed in any manner, with care to be taken that the steel core in the reinforced-concrete beam is not damaged. For example, the pocket is cut out or milled out of the concrete. For example, a high-pressure water jet is used to make the recess of the pocket.

Figure 17A:
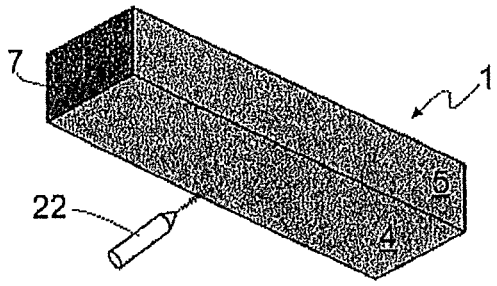
FIGS. 17*a* to 17*c* are schematic depictions of a method according to an exemplary embodiment of the disclosure for anchoring the end of a tension member to a reinforced-concrete beam.
Figure 17B:
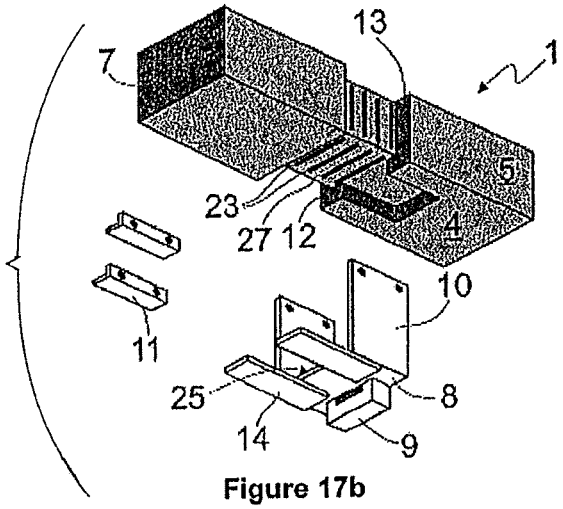
Figure 17C:
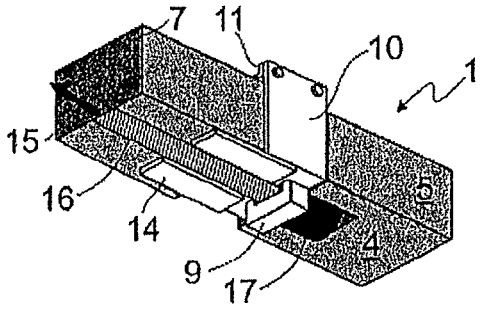

FIGS. 17*a*, 17*b* and 17*c* show an exemplary embodiment of a method according to the disclosure.

FIG. 17*a* shows a reinforced-concrete beam 1 with a steel core 7, as it has previously been described. The flange underside 4 and one flange side 5 are depicted. A connecting piece is provided for the reinforced-concrete beam and the flange upper sides. Additionally, FIG. 17*a* shows a high-pressure water-jet device 22, by which, on the flange underside and on the flange sides of the reinforced-concrete beam, a pocket for the device is recessed. In addition, a pocket is recessed for the grip head.

FIG. 17*b* shows the reinforced-concrete beam 1 with the recessed pocket 12 on the flange underside 4 and 13 on the flange sides 5, and additionally the pocket which was recessed for the grip head. In the recessed pockets 12 and 13, which are provided for the device, an adhesive 23 is applied to bond the device with the reinforced-concrete beam.

In addition, FIG. 17*b* shows a device for anchoring the ends of tension members made of fiber-reinforced plastic flat-strip lamellas including a base plate 8 with an attachment element 9 for the tension member, two lateral parts 10, two protrusions 11 not yet installed on the lateral parts, and an extension 14. The extension is configured in two pieces, so that in the center space remains for the tension member.

FIG. 17*c* shows the reinforced-concrete beam 1 on which the device for anchoring the ends of tension members made of fiber-reinforced plastic flat-strip lamellas was installed. After positioning the device on the reinforced-concrete beam, the protrusions 11 were installed with screws on the lateral parts, thus securing the device on the reinforced-concrete beam. The adhesive, which is shown in FIG. 17*b*, also contributes to the attachment of the device after it has cured.

Additionally, FIG. 17*c* shows a tension member 16 installed on the device. On its end depicted, it is equipped with a grip head 17, which, as viewed in the tensile direction 15 of the tensile member, is situated behind the attachment element 9, in this case a slotted plate.

Due to the tension which is exerted by tension member 16 in the tensile direction 15 on the device, the device is wedged with the reinforced-concrete beam. The degree of wedging depends on the geometry of the device and the type of adhesive bonding of the device on the reinforced-concrete beam. The wedging can have a positive effect on the stability of the device.

The tension member 16 is glued in a state of being under tension with the reinforced-concrete beam. Especially suitable as adhesives for gluing the tension member with the reinforced-concrete beam are two-component adhesives based on epoxy resins as are commercially available for example under the trade name SIKADUR from Sika Schweiz AG.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

1 Reinforced-concrete beam
2 Connecting piece
3 flange
4 flange underside
5 flange side
6 flange upper side
7 Steel core
7*a* untensioned steel core
7*b* tensioned steel core
8 Base plate
9 attachment element for tension member
10 lateral part
11 protrusion
12 Recessed pocket on the flange underside
13 Recessed pocket on the flange side
14 extension
15 tensile direction of the tension member
16 tension member
17 grip head
18 tensile element
19 threaded rod
20 bolt nut
21 leg
22 high-pressure water-spray device
23 adhesive
24 rib
25 front surface of base plate
26 flank of the recessed pocket
27 base of the recessed pocket
28 projecting element
29 front surface of the projecting element

What is claimed is:

1. A reinforced concrete beam, comprising:
a connecting piece;
a flange with a horizontal flange underside;
two flange sides; and
two flange upper sides running from the flange sides to the connecting piece;
at least one device for anchoring ends of tension members made of fiber-reinforced plastic flat-strip lamellas, the device including:
a base plate running horizontally on the flange underside; and
at least one lateral part running vertically along at least one of the flange sides, wherein at least one of the base plate and the at least one lateral part includes at least one attachment element for a tension member; and
the at least one lateral part in an area where the flange tapers toward the connecting piece, includes a protrusion directed toward the connecting piece, which can be at least partially braced on one of the flange upper sides, wherein the beam comprises:
a recessed pocket in an area where the device is located, and at least one part of the device is located in the recessed pocket, and wherein the device comprises:
an extension, which extends in an intended tensile direction of the tension member, over the recessed pocket to directly contact the flange underside.

2. The reinforced concrete beam according to claim 1, comprising:
the recessed pocket at least in an area of the base plate and/or the lateral part, wherein the at least one of the base plate constructed with the at least one attachment element for a tension member and/or the lateral part with the attachment element for a tension member are in the pocket.

3. The reinforced concrete beam according to claim 1, comprising:
the recessed pocket on the flange underside, and wherein the base plate with the at least one attachment element for a tension member includes at least one protruding element extending into the recessed pocket.

4. The reinforced concrete beam according to claim 3, wherein the recessed pocket and the projecting element at least in part are complementary to each other.

5. The reinforced concrete beam according to claim 1, wherein the device is adhesively bonded to the reinforced concrete beam.

6. The reinforced concrete beam according to claim 1, wherein the extension includes two parts which are each disposed on opposite sides of the flange underside along the tension member and extend in the intended tensile direction.

7. A method for anchoring ends of tension members made of fiber-reinforced plastic flat-strip lamellas on reinforced-concrete beams, wherein the reinforced concrete beams include a connecting piece and a flange with a horizontal flange underside, two flange sides and two flange upper sides running from the flange sides to the connecting piece, the method comprising:
installing a device on the reinforced-concrete beam, the device including a base plate running horizontally on the flange underside and at least one lateral part running vertically along at least one flange side, at least one of the base plate and the at least one lateral part including at least one attachment element for a tension member and the at least one lateral part, in an area of tapering of the flange to the connecting piece, includes a protrusion directed against the connecting piece, which is braced at least partially on one of the flange upper sides;
installation of a tension member on the attachment element;
placing of the tension member under tension;
providing a recessed pocket on the reinforced concrete beam in the area where the device is to be installed;
installing at least a part of the device in the recessed pocket; and providing the device with an extension, which extends in an intended tensile direction of the tension member, over the recessed pocket to directly contact the flange underside.

8. The method according to claim 7, comprising:

wedging the device with the reinforced concrete beam during placement of tension on the tension member.

9. The method according to claim 7, wherein the extension includes two parts which are each disposed on opposite sides of the flange underside along the tension member and extend in the intended tensile direction.

10. The method according to claim 9, comprising:

providing the recessed pocket on the reinforced concrete beam, at least in an area where the base plate with the at least one attachment element for the tension member and/or the at least one lateral part with the at least one attachment element for a tension member is to be installed.

11. The method according to claim 9, comprising:

providing the at least one recessed pocket on the reinforced concrete beam, at least in a place where the base plate with the at least one attachment element for the tension member is situated, wherein the base plate with the at least one attachment element for a tension member includes at least one protruding element which extends into the pocket.

12. A device for anchoring ends of tension members made of fiber-reinforced plastic flat-strip lamellas on reinforced-concrete beams, including a connecting piece and a flange with a horizontal flange underside, two flange sides and two flange upper sides running from the flange sides to the connecting piece, the device comprising:

a base plate for running on the flange underside configured to be positioned horizontally; and at least one lateral part for running along at least one of the flange sides and configured to be positioned vertically;

wherein at least one of the base plate and the at least one lateral part include at least one attachment element for a tension member; and wherein the at least one lateral part is arranged to be placed so, in an area where the flange tapers toward the connecting piece, it includes a protrusion for directing toward the connecting piece, which can be at least partially braced on at least one flange upper side, wherein the base plate comprises:

an extension, which extends in an intended tensile direction of the tension member for directly contacting the underside of the flange so that compression forces are applied via the extension to the flange underside, wherein the extension includes two parts which are each disposed on opposite sides of the flange underside along the tension member and extend in the intended tensile direction.

13. The device according to claim 12, wherein the base plate with the attachment element for the tension member comprises:

at least one element protruding in the direction of the lateral parts.

* * * * *